US012304606B2

(12) United States Patent
Matsunaga et al.

(10) Patent No.: US 12,304,606 B2
(45) Date of Patent: May 20, 2025

(54) OUTBOARD MOTOR AND MARINE VESSEL

(71) Applicant: YAMAHA HATSUDOKI KABUSHIKI KAISHA, Iwata (JP)

(72) Inventors: Takuma Matsunaga, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 510 days.

(21) Appl. No.: 17/717,191

(22) Filed: Apr. 11, 2022

(65) Prior Publication Data

US 2022/0332400 A1 Oct. 20, 2022

(30) Foreign Application Priority Data

Apr. 20, 2021 (JP) ..... 2021-071154

(51) Int. Cl.
*B63H 20/12* (2006.01)
*B63H 20/00* (2006.01)
*B63H 20/10* (2006.01)

(52) U.S. Cl.
CPC ..... *B63H 20/12* (2013.01); *B63H 20/001* (2013.01); *B63H 20/10* (2013.01)

(58) Field of Classification Search
CPC ..... B63H 20/12; B63H 20/001; B63H 20/10; B63H 25/12
See application file for complete search history.

(56) References Cited

U.S. PATENT DOCUMENTS 4,773,882 A * 9/1988 Rump ..... B63H 25/12 440/61 R
7,150,664 B1 * 12/2006 Uppgard ..... B63H 20/12 440/61 C
2004/0139902 A1 * 7/2004 Takada ..... B63H 20/12 114/144 R
2020/0307753 A1 10/2020 Mizutani et al.

FOREIGN PATENT DOCUMENTS

EP 1 488 996 A2 12/2004
EP 1 626 000 A2 2/2006
JP 2020-168889 A 10/2020
WO 2007/085515 A1 8/2007

OTHER PUBLICATIONS

Official Communication issued in corresponding European Patent Application No. 22168479.8, mailed on Oct. 12, 2022.

* cited by examiner

*Primary Examiner* — Andrew Polay
(74) *Attorney, Agent, or Firm* — Keating & Bennett, LLP

(57) ABSTRACT

An outboard motor includes an outboard motor body, a steering shaft, a steering cylinder including a piston rod extending in a right-left direction of the outboard motor body, a piston fixed to the piston rod, and a cylinder body including an oil chamber and the piston therein, and an oil passage inside the piston rod and connected to the oil chamber. The steering cylinder is operable to rotate the steering shaft and the outboard motor body in the right-left direction by adjusting an amount of oil in the oil chamber and moving the cylinder body in the right-left direction.

20 Claims, 7 Drawing Sheets

FIRST PREFERRED EMBODIMENT

ENLARGED B1

VIII–VIII CROSS-SECTION

IX–IX CROSS-SECTION

ENLARGED B2

XI-XI CROSS-SECTION

XII-XII CROSS-SECTION

SECOND PREFERRED EMBODIMENT

OUTBOARD MOTOR AND MARINE VESSEL

CROSS REFERENCE TO RELATED APPLICATIONS

This application claims the benefit of priority to Japanese Patent Application No. 2021-071154 filed on Apr. 20, 2021. The entire contents of this application are hereby incorporated herein by reference.

BACKGROUND OF THE INVENTION

1. Field of the Invention

The present invention relates to an outboard motor and a marine vessel each including a steering cylinder.

2. Description of the Related Art

An outboard motor including a steering cylinder is known in general. Such an outboard motor is disclosed in Japanese Patent Laid-Open No. 2020-168889, for example.

Japanese Patent Laid-Open No. 2020-168889 discloses an outboard motor including an outboard motor body and a hydraulic steering cylinder that rotates the outboard motor body in a right-left direction. The steering cylinder includes a piston, a piston rod to which the piston is fixed, and a cylindrical cylinder body with the piston and an oil chamber being provided therein. The steering cylinder rotates a steering shaft and the outboard motor body in the right-left direction by adjusting the amount of oil in the oil chamber and moving the cylinder body in the right-left direction. An oil passage is provided inside the cylinder body. The steering cylinder supplies and discharges oil to and from the oil chamber via a hydraulic oil pipe connected to the cylinder body (oil passage).

In the outboard motor disclosed in Japanese Patent Laid-Open No. 2020-168889, as the cylinder body moves in the right-left direction, the hydraulic oil pipe connected to the cylinder body also disadvantageously moves in the right-left direction. When the hydraulic oil pipe moves in the right-left direction, it is necessary to provide a moving space for the hydraulic oil pipe to move such that the hydraulic oil pipe does not interfere with other structures during the movement. Therefore, the moving space for the hydraulic oil pipe is provided, and thus a space in the vicinity of or adjacent to a stern to which the outboard motor is attached is narrowed. Thus, it is desired to enlarge the space in the vicinity of or adjacent to the stern to which the outboard motor is attached.

SUMMARY OF THE INVENTION

Preferred embodiments of the present invention provide outboard motors and marine vessels that each provide larger spaces in the vicinity of or adjacent to sterns to which the outboard motors are attached.

An outboard motor according to a preferred embodiment of the present invention includes an outboard motor body, a steering shaft, a steering cylinder including a piston rod extending in a right-left direction of the outboard motor body, a piston fixed to the piston rod, and a cylinder body including an oil chamber and the piston therein, and an oil passage inside the piston rod and connected to the oil chamber, wherein the steering cylinder is operable to rotate the steering shaft and the outboard motor body in the right-left direction by adjusting an amount of oil in the oil chamber and moving the cylinder body in the right-left direction.

An outboard motor according to a preferred embodiment of the present invention includes the steering cylinder to rotate the steering shaft and rotate the outboard motor body in the right-left direction by adjusting the amount of oil in the oil chamber and moving the cylinder body in the right-left direction, and the oil passage provided inside the piston rod and connected to the oil chamber. Accordingly, the oil passage is provided inside the piston rod that does not move in the right-left direction, instead of the cylinder body that moves in the right-left direction when the outboard motor body is rotated in the right-left direction, and thus the oil passage is prevented from moving in the right-left direction when the outboard motor body is rotated in the right-left direction. Therefore, the oil pipe connected to the piston rod (oil passage) is prevented from moving in the right-left direction. Consequently, it is no longer necessary to provide, in the right-left direction of the outboard motor body, a moving space for the oil pipe to move in the right-left direction, unlike the conventional case, and thus a larger space is provided in the vicinity of or adjacent to a stern to which the outboard motor is attached.

An outboard motor according to a preferred embodiment of the present invention preferably further includes an oil pipe connected to the oil passage in the piston rod in a vicinity of or adjacent to an end of the piston rod. When the oil passage is provided inside the piston rod, it is necessary to limit the moving range of the cylinder body in the right-left direction to a range that does not interfere with the oil pipe such that the cylinder body does not interfere with the oil pipe. Therefore, with the structure described above, the oil pipe is connected to the oil passage in the vicinity of or adjacent to the end of the piston rod, and thus a larger moving range of the cylinder body in the right-left direction is provided. Thus, a larger space is provided in the vicinity of or adjacent to the stern to which the outboard motor is attached, and a larger moving range of the cylinder body in the right-left direction is provided.

An outboard motor according to a preferred embodiment of the present invention preferably further includes a swivel bracket attached to the outboard motor body and rotatable in an upward-downward direction, and a clamp bracket fixed to a hull and attached to the swivel bracket such that the swivel bracket is rotatable in the upward-downward direction, and the steering cylinder is preferably rotatably attached to the clamp bracket. Accordingly, the steering cylinder is rotatably attached to the clamp bracket that does not rotate in the upward-downward direction, and thus the steering cylinder is prevented from moving in the upward-downward direction when the outboard motor body is rotated together with the swivel bracket in the upward-downward direction. Consequently, it is not necessary to provide, in the upward-downward direction, a moving space for the oil pipe to move in the upward-downward direction, and thus a larger space is provided in the vicinity of or adjacent to the stern to which the outboard motor is attached.

In such a case, an outboard motor according to a preferred embodiment of the present invention preferably further includes a rotation device to rotate the swivel bracket and the outboard motor body in the upward-downward direction about a tilt shaft, and the piston rod is preferably coaxial or substantially coaxial with the tilt shaft. Accordingly, the piston rod is coaxial or substantially coaxial with the tilt shaft, and thus when the outboard motor body is rotated in the upward-downward direction about the tilt shaft, distances between the piston rod and both the outboard motor body that rotates in the upward-downward direction and the steering shaft that is the center of rotation of the outboard motor body in the right-left direction are maintained constant or substantially constant. Consequently, the rotation device smoothly rotates the outboard motor body in the upward-downward direction, and the steering cylinder smoothly rotates the outboard motor body in the right-left direction.

An outboard motor including the swivel bracket and the clamp bracket preferably further includes a steering oil supply/discharge device to supply and discharge oil to and from the oil chamber via the oil passage, and the steering oil supply/discharge device is preferably attached to the clamp bracket. Accordingly, the steering oil supply/discharge device connected to the steering cylinder via the oil pipe is also attached to the same clamp bracket as the steering cylinder, and thus movement of the oil pipe in the vicinity of or adjacent to both ends of the oil pipe is effectively significantly reduced or prevented. Consequently, a larger space is provided in the vicinity of or adjacent to the stern to which the outboard motor is attached.

In such a case, an outboard motor according to a preferred embodiment of the present invention preferably further includes an oil pipe connected to the oil passage provided in the piston rod in a vicinity of or adjacent to an end of the piston rod, and an adapter provided at the end of the piston rod to connect the oil passage to the oil pipe, and the adapter is preferably maintained at a predetermined rotation position about a central axis of the piston rod without rotating about the central axis when the outboard motor body and the swivel bracket rotate in the upward-downward direction. Accordingly, when the outboard motor body and the swivel bracket rotate in the upward-downward direction, the adapter is maintained at the predetermined rotation position about the central axis of the piston rod also at an end of the oil pipe connected to the adapter. Therefore, in addition to restriction of movement of the oil pipe in the right-left direction and in the upward-downward direction, the adapter is maintained at the predetermined rotation position about the central axis of the piston rod, and thus movement of the oil pipe is more effectively significantly reduced or prevented. Consequently, a particularly large space is provided in the vicinity of or adjacent to the stern to which the outboard motor is attached.

In an outboard motor including the oil pipe and the adapter, the adapter preferably engages with the end of the piston rod and is rotatable with respect to the piston rod, the oil passage preferably includes a groove-shaped oil passage extending in a circumferential direction of the piston rod along an outer peripheral surface of the piston rod that is covered by the adapter, and the groove-shaped oil passage is preferably in constant communication with a connection port of the oil pipe to the adapter regardless of a rotation position of the piston rod. Accordingly, even when the piston rod rotates, with the groove-shaped oil passage that extends in the circumferential direction of the piston rod along the outer peripheral surface of the piston rod that is covered by the adapter, the oil pipe is reliably connected to the oil passage (groove-shaped oil passage).

In an outboard motor including the groove-shaped oil passage that is in constant communication with the connection port of the oil pipe to the adapter regardless of the rotation position of the piston rod, the oil pipe is preferably made of metal, and is preferably connected to the adapter to maintain a position of the connection port of the oil pipe. Accordingly, the oil pipe is made of metal and maintains the position of the connection port of the oil pipe to the adapter, and thus a change in the shape of the oil pipe is significantly reduced or prevented. Consequently, the oil pipe is fixed in a predetermined space, and thus a larger space is provided in the vicinity of or adjacent to the stern to which the outboard motor is attached.

In an outboard motor including the oil pipe and the adapter, the piston rod preferably protrudes outward from the clamp bracket in the right-left direction, and the oil pipe is preferably connected to the oil passage via the adapter on an outer side of the clamp bracket in the right-left direction. Accordingly, the oil pipe is provided on the outer side of the clamp bracket in the left-right direction, and thus the oil pipe is provided at a position at which the cylinder body is unlikely to interfere with the oil pipe.

In an outboard motor according to a preferred embodiment of the present invention, the oil passage is preferably connected to the oil chamber in a vicinity of or adjacent to the piston. Accordingly, when the cylinder body is moved in the right-left direction, the cylinder body is moved to the vicinity of the piston within a range in which the oil passage is not blocked by the cylinder body. That is, a larger moving range of the cylinder body is provided in the right-left direction.

In an outboard motor according to a preferred embodiment of the present invention, the oil chamber preferably includes a left oil chamber on a left side of the piston and a right oil chamber on a right side of the piston, the oil passage preferably includes a left oil passage connected to the left oil chamber, and a right oil passage connected to the right oil chamber, oil is preferably supplied from a vicinity of a same outer end of the piston rod to the left oil passage and the right oil passage, and oil is preferably discharged from the left oil passage and the right oil passage to the vicinity of the same outer end of the piston rod. Accordingly, the oil pipe is provided on the same outer side of the piston rod, and thus unlike a case in which the left oil passage and the right oil passage are provided in the vicinity of different outer ends of the piston rod, respectively, the device structure is simplified.

In such a case, the piston rod preferably includes a double pipe structure including a large-diameter tubular portion extending in an axial direction of the piston rod and a small-diameter tubular portion located inward of the large-diameter tubular portion to extend in the axial direction, the left oil passage is preferably defined by one of an inner side of the small-diameter tubular portion and a gap between the large-diameter tubular portion and the small-diameter tubular portion, and the right oil passage is preferably defined by another of the inner side of the small-diameter tubular portion and the gap between the large-diameter tubular portion and the small-diameter tubular portion. Accordingly, the piston rod has a double pipe structure including the large-diameter tubular portion and the small-diameter tubular portion such that two different oil passages that do not communicate with each other in a cross-section perpendicular to the longitudinal direction of the piston rod are easily provided with respect to the piston rod.

An outboard motor in which oil is supplied from the vicinity of the same outer end of the piston rod to the left oil passage and the right oil passage, and oil is discharged from the left oil passage and the right oil passage to the vicinity of the same outer end of the piston rod preferably further includes a bypass valve provided in a vicinity of or adjacent to an end of the piston rod to communicate the left oil passage with the right oil passage when the bypass valve is opened. Accordingly, the bypass valve communicates the left oil passage with the right oil passage to allow the cylinder body to be manually moved. Consequently, the cylinder body is manually moved to easily perform maintenance work such as removing air from the inside of the cylinder body.

In an outboard motor according to a preferred embodiment of the present invention, the oil passage preferably includes an axial oil passage extending in an axial direction of the piston rod, and a plurality of radial oil passages that branch from the axial oil passage, extend in a radial direction of the piston rod, and are connected to the oil chamber. Accordingly, due to the plurality of radial oil passages, a flow passage sectional area between the oil chamber and the axial oil passage is increased. Consequently, when oil is supplied from the axial oil passage to the oil chamber and when oil is discharged from the oil chamber to the axial oil passage, the plurality of radial oil passages allow the oil to flow smoothly between the oil chamber and the axial oil passage.

A marine vessel according to a preferred embodiment of the present invention includes a hull including a steering wheel, and an outboard motor attached to the hull, and the outboard motor includes an outboard motor body, a steering shaft, a steering cylinder including a piston rod extending in a right-left direction of the outboard motor body, a piston fixed to the piston rod, and a cylinder body including an oil chamber and the piston therein; and an oil passage provided inside the piston rod and connected to the oil chamber, wherein the steering cylinder rotates the steering shaft and the outboard motor body in the right-left direction by adjusting an amount of oil in the oil chamber and moving the cylinder body in the right-left direction based on an operation of the steering wheel.

A marine vessel according to a preferred embodiment of the present invention includes the steering cylinder to rotate the steering shaft and the outboard motor body in the right-left direction by adjusting the amount of oil in the oil chamber and moving the cylinder body in the right-left direction, and the oil passage provided inside the piston rod and connected to the oil chamber. Accordingly, the oil passage is provided inside the piston rod that does not move in the right-left direction, instead of the cylinder body that moves in the right-left direction when the outboard motor body is rotated in the right-left direction, and thus the oil passage is prevented from moving in the right-left direction when the outboard motor body is rotated in the right-left direction. Therefore, the oil pipe connected to the piston rod (oil passage) is prevented from moving in the right-left direction. Consequently, it is no longer necessary to provide, in the right-left direction of the outboard motor body, a moving space for the oil pipe to move in the right-left direction, unlike the conventional case, and thus a larger space is provided in the vicinity of or adjacent to a stern to which the outboard motor is attached.

In a marine vessel according to a preferred embodiment of the present invention, the outboard motor preferably further includes an electric pump that is driven based on an electric signal transmitted from the steering wheel to adjust the amount of oil in the oil chamber. Accordingly, in the marine vessel of a type in which the amount of oil in the oil chamber is adjusted using the electric pump, which is a structure of the outboard motor, a larger space is provided in the vicinity of or adjacent to the stern to which the outboard motor is attached.

In a marine vessel including the hull and the outboard motor, the hull preferably further includes a steering wheel driven pump that is mechanically driven based on an operation of the steering wheel to adjust the amount of oil in the oil chamber. Accordingly, in the marine vessel of a type in which the amount of oil in the oil chamber is adjusted using the steering wheel driven pump, which is a structure on the hull, a larger space is provided in the vicinity of or adjacent to the stern to which the outboard motor is attached.

In a marine vessel according to a preferred embodiment of the present invention, the outboard motor preferably further includes an oil pipe connected to the oil passage in the piston rod in a vicinity of or adjacent to an end of the piston rod. When the oil passage is provided inside the piston rod, it is necessary to limit the moving range of the cylinder body in the right-left direction to a range that does not interfere with the oil pipe such that the cylinder body does not interfere with the oil pipe. Therefore, with the structure described above, the oil pipe is connected to the oil passage in the vicinity of or adjacent to the end of the piston rod, and thus a larger moving range of the cylinder body in the right-left direction is provided. Thus, a larger space is provided in the vicinity of or adjacent to the stern to which the outboard motor is attached, and a larger moving range of the cylinder body in the right-left direction is provided.

In a marine vessel according to a preferred embodiment of the present invention, the outboard motor preferably further includes a swivel bracket attached to the outboard motor body and rotatable in an upward-downward direction, and a clamp bracket fixed to the hull and attached to the swivel bracket such that the swivel bracket is rotatable in the upward-downward direction, and the steering cylinder is preferably rotatably attached to the clamp bracket. Accordingly, the steering cylinder is rotatably attached to the clamp bracket that does not rotate in the upward-downward direction, and thus the steering cylinder is prevented from moving in the upward-downward direction when the outboard motor body is rotated together with the swivel bracket in the upward-downward direction. Consequently, it is not necessary to provide, in the upward-downward direction, a moving space for the oil pipe to move in the upward-downward direction, and thus a larger space is provided in the vicinity of or adjacent to the stern to which the outboard motor is attached.

In such a case, the outboard motor preferably further includes a rotation device to rotate the swivel bracket and the outboard motor body in the upward-downward direction about a tilt shaft, and the piston rod is preferably coaxial or substantially coaxial with the tilt shaft. Accordingly, the piston rod is coaxial or substantially coaxial with the tilt shaft, and thus when the outboard motor body is rotated in the upward-downward direction about the tilt shaft, distances between the piston rod and both the outboard motor body that rotates in the upward-downward direction and the steering shaft that is the center of rotation of the outboard motor body in the right-left direction are maintained substantially constant. Consequently, the rotation device smoothly rotates the outboard motor body in the upward-downward direction, and the steering cylinder smoothly rotates the outboard motor body in the right-left direction.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 100 including an outboard motor 101 according to a first preferred embodiment of the present invention is now described with reference to FIGS. 1 to 12.

In the figures, arrow FWD represents the forward movement direction of the marine vessel 100 (front side with reference to a hull 100*a*), and arrow BWD represents the reverse movement direction of the marine vessel 100 (rear side with reference to the hull 100*a*).

In the figures, arrow L represents the portside direction of the marine vessel 100 (portside direction with respect to the hull 100*a*), and arrow R represents the starboard direction of the marine vessel 100 (starboard direction with respect to the hull 100*a*). The directions indicated by arrow L and arrow R in the figures correspond to the right-left direction of the marine vessel 100 (outboard motor 101). In each figure, the central axis of a piston rod 50 that extends in the right-left direction is indicated by $\alpha$.

In the figures, arrow Z1 represents the upper side of the marine vessel 100, and arrow Z2 represents the lower side of the marine vessel 100.

Figure 1:
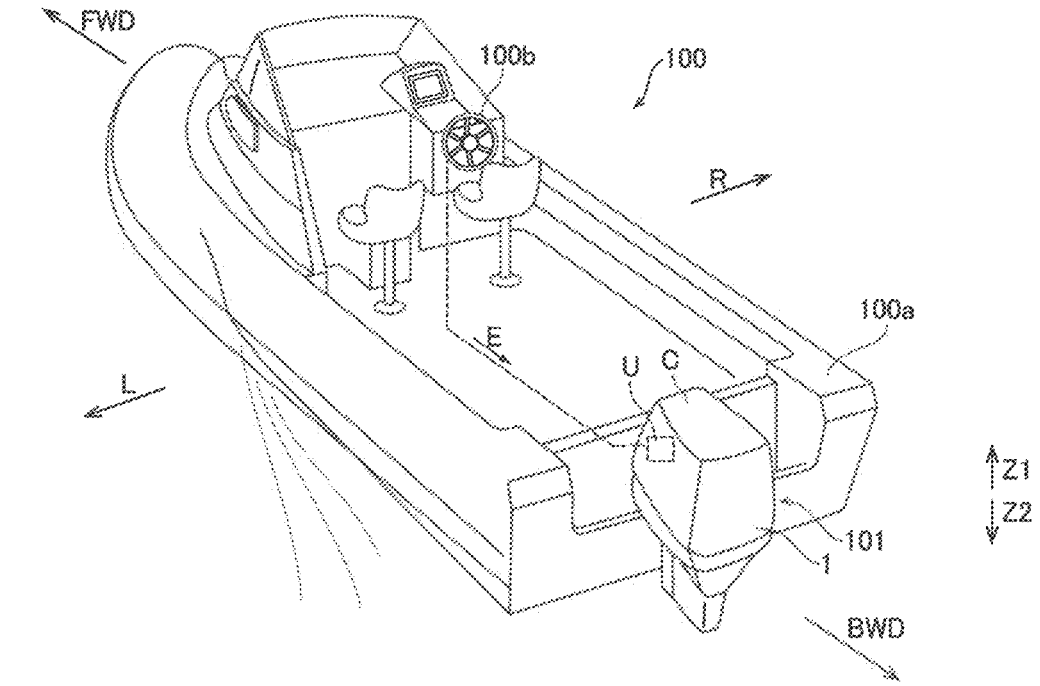
FIG. 1 is a perspective view schematically showing a marine vessel including an outboard motor according to a first preferred embodiment of the present invention.

As shown in FIG. 1, the marine vessel 100 includes the hull 100*a* and the outboard motor 101.

The outboard motor 101 is attached to a transom of the hull 100*a*. That is, the marine vessel 100 is an outboard motor boat including the outboard motor 101.

The hull 100*a* includes a steering wheel 100*b*. The marine vessel 100 transmits an electric signal E to a steering control unit U provided in a cowling C of the outboard motor 101 in accordance with the operation of the steering wheel 100*b*. The marine vessel 100 drives an electric pump 81 (see FIG. 5) that adjusts the amount of oil in a steering cylinder 5 (see FIG. 5) based on the electric signal E transmitted from the steering wheel 100*b* to the steering control unit U. Consequently, an outboard motor body 1 rotates in the right-left direction.

The outboard motor 101 shown in FIGS. 2 to 6 includes the outboard motor body 1, a pair of clamp brackets 2 to attach the outboard motor body 1 to the transom of the hull 100*a*, and a swivel bracket 3 to support the outboard motor body 1. The pair of clamp brackets 2 face each other in the right-left direction when attached to the hull 100*a*.

Figure 4:
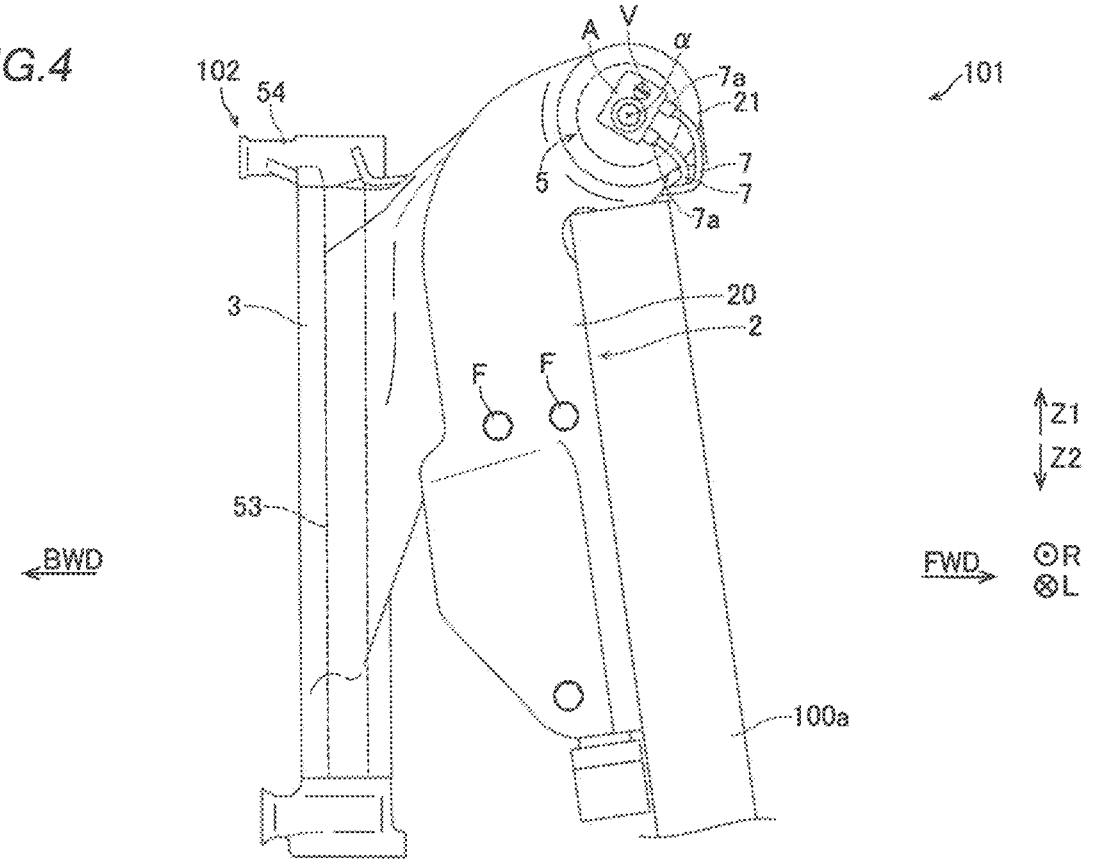
FIG. 4 is a right side view showing the outboard motor (a clamp bracket, the swivel bracket, the steering device, the oil pipes, and an adapter) according to the first preferred embodiment of the present invention.

As shown in FIG. 4, the outboard motor 101 includes a hydraulic power trim-tilt device (PTT device) 4 to rotate the outboard motor body 1 (see FIG. 2) in an upward-downward direction, and a hydraulic steering device 102 to rotate the outboard motor body 1 in the right-left direction. The power trim-tilt device 4 is an example of a "rotation device".

In the hydraulic steering device 102 (steering cylinder 5) according to the first preferred embodiment of the present invention, an oil chamber 55 (a left oil chamber 55*a* and a right oil chamber 55*b*) is provided inside a cylinder body 52, and an oil passage 6 is provided inside the piston rod 50 that guides movement of the cylinder body 52 in the right-left direction. A first end of the oil passage 6 is connected to the oil chamber 55. A second end of the oil passage 6 is connected to oil pipes 7 via an adapter A. The piston rod 50 does not move in the right-left direction.

Therefore, in the hydraulic steering device 102 according to the first preferred embodiment of the present invention, even when the cylinder body 52 is guided by the piston rod 50 to move in the right-left direction, the oil passage 6 inside the piston rod 50 and the oil pipes 7 maintain the same positions without moving in the right-left direction.

Figure 2:
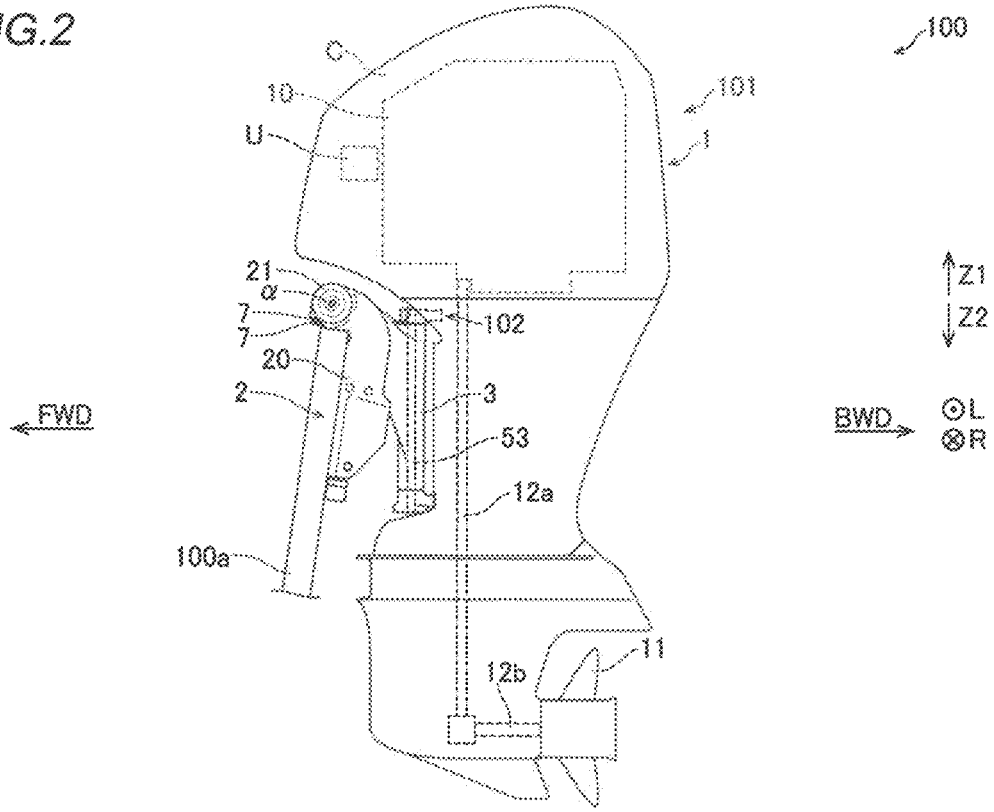
FIG. 2 is a left side view showing the overall structure of the outboard motor according to the first preferred embodiment of the present invention.
Figure 3:
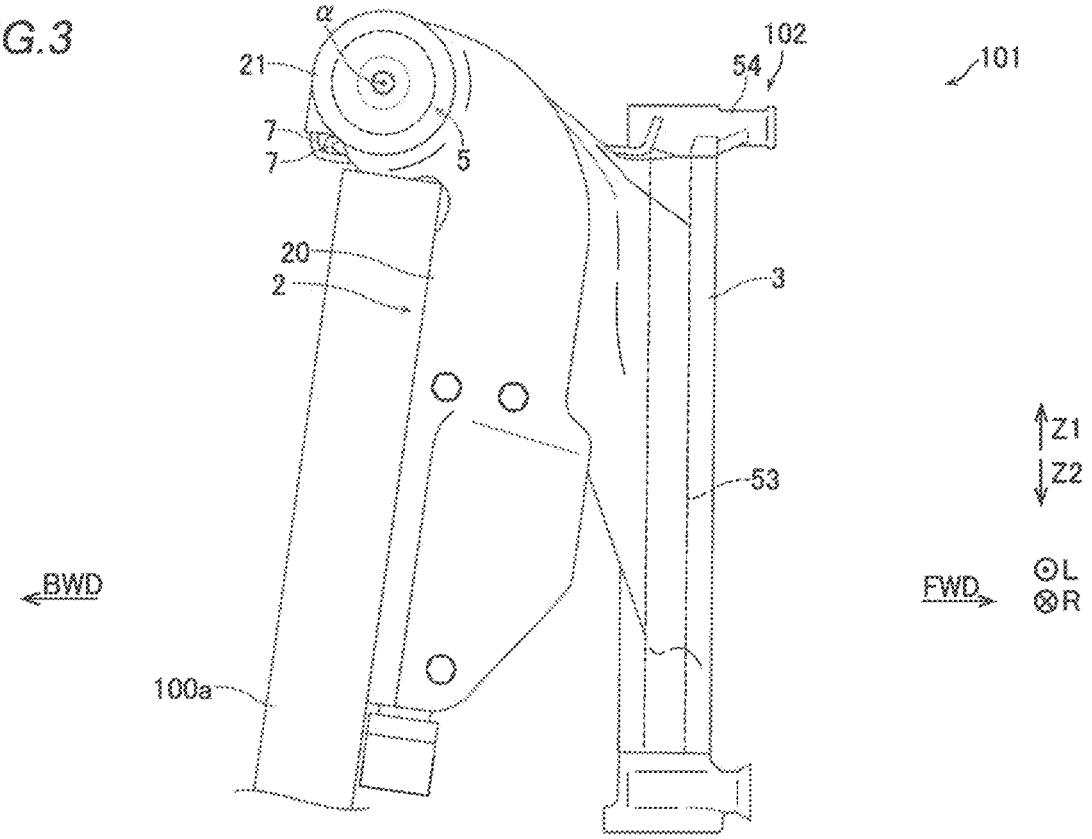
FIG. 3 is a left side view showing the outboard motor (a clamp bracket, a swivel bracket, a steering device, and oil pipes) according to the first preferred embodiment of the present invention.

As shown in FIG. 2, the outboard motor body 1 includes an engine 10 as a driving force source, a propeller 11, and a drive shaft 12*a* and a propeller shaft 12*b*, both of which transmit a driving force from the engine 10 to the propeller 11.

When the marine vessel 100 is propelled, the outboard motor body 1 is rotated in the upward-downward direction together with the swivel bracket 3 with respect to the clamp brackets 2 by the power trim-tilt device 4 (see FIG. 4), and the upward-downward orientation of the propeller 11 positioned in the water is adjusted.

When the marine vessel 100 is stopped or starts to be propelled, the outboard motor body 1 is rotated in the upward-downward direction together with the swivel bracket 3 with respect to the clamp brackets 2 by the power trim-tilt device 4, and the position of the propeller 11 is changed between underwater and above water.

When the marine vessel 100 is propelled, the outboard motor body 1 is rotated in the right-left direction with respect to the swivel bracket 3 (clamp brackets 2) by the steering device 102 (see FIG. 4), and the right-left orientation of the propeller 11 positioned in the water is adjusted.

Figure 5:
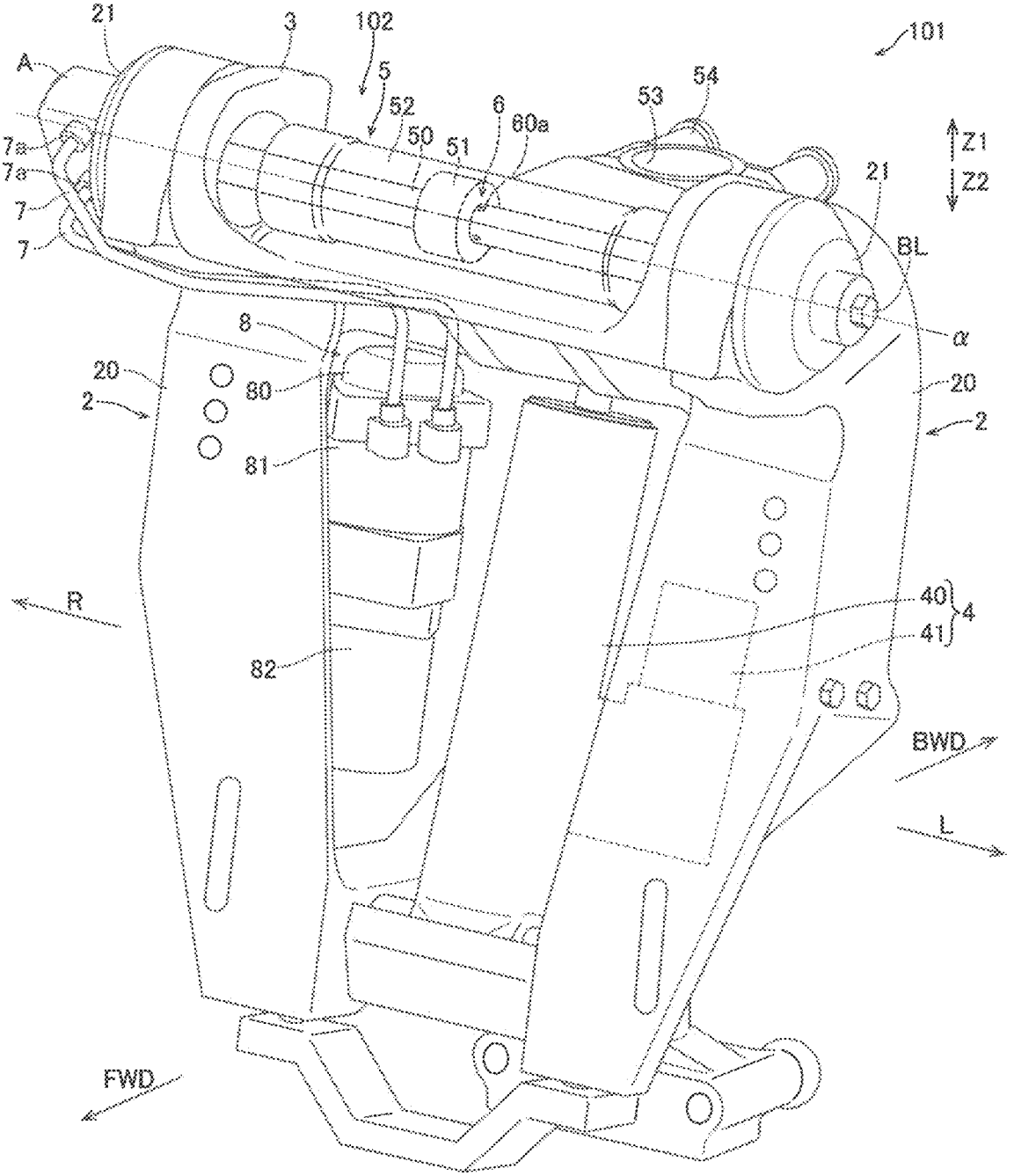
FIG. 5 is a perspective view showing the outboard motor (the clamp brackets, the swivel bracket, the steering device, the oil pipes, and the adapter) according to the first preferred embodiment of the present invention from the front side.
Figure 6:
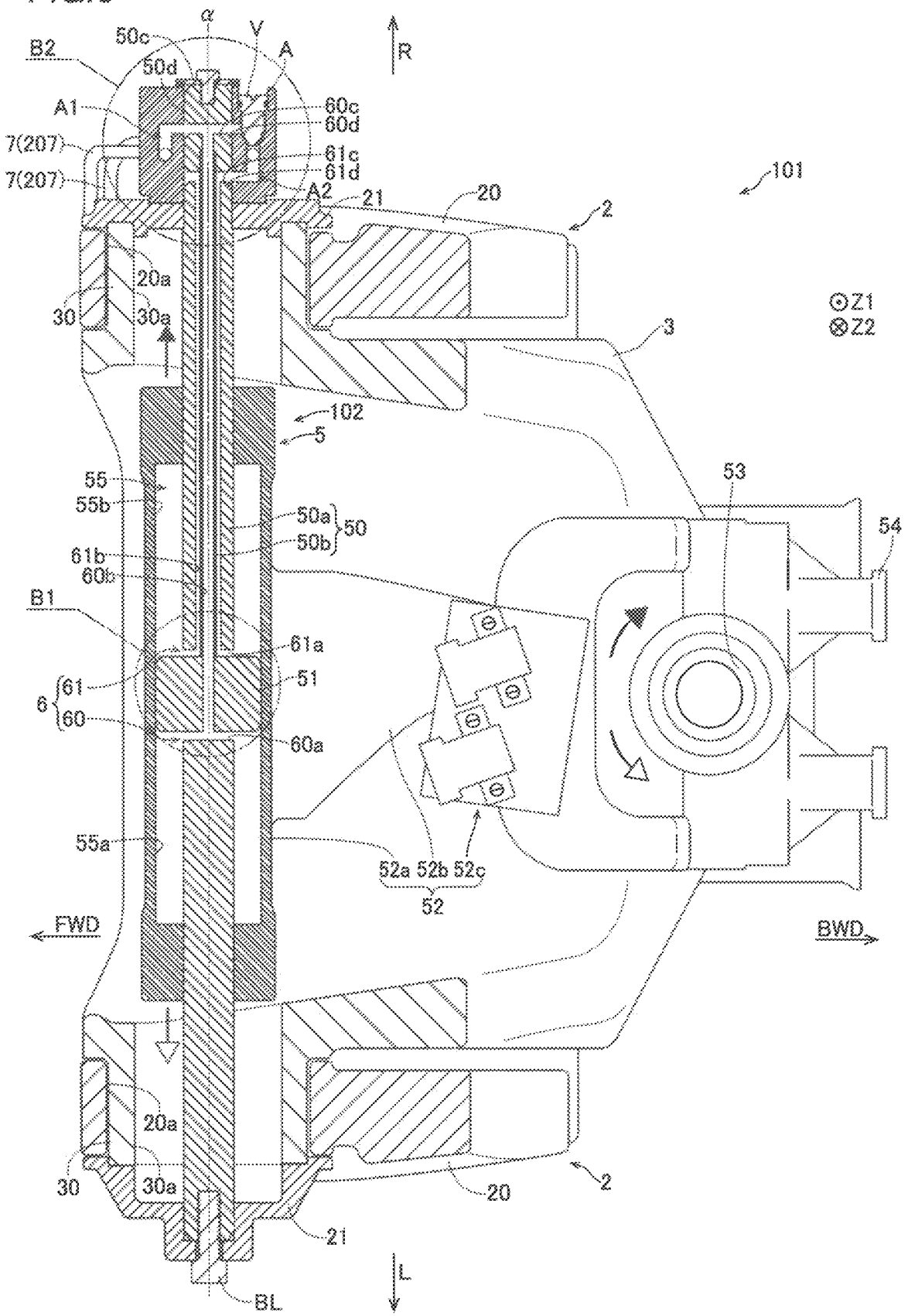
FIG. 6 is a plan view showing an outboard motor according to first and second preferred embodiments of the present invention, cut by a horizontal plane along the central axis of a piston rod.
Figure 7:
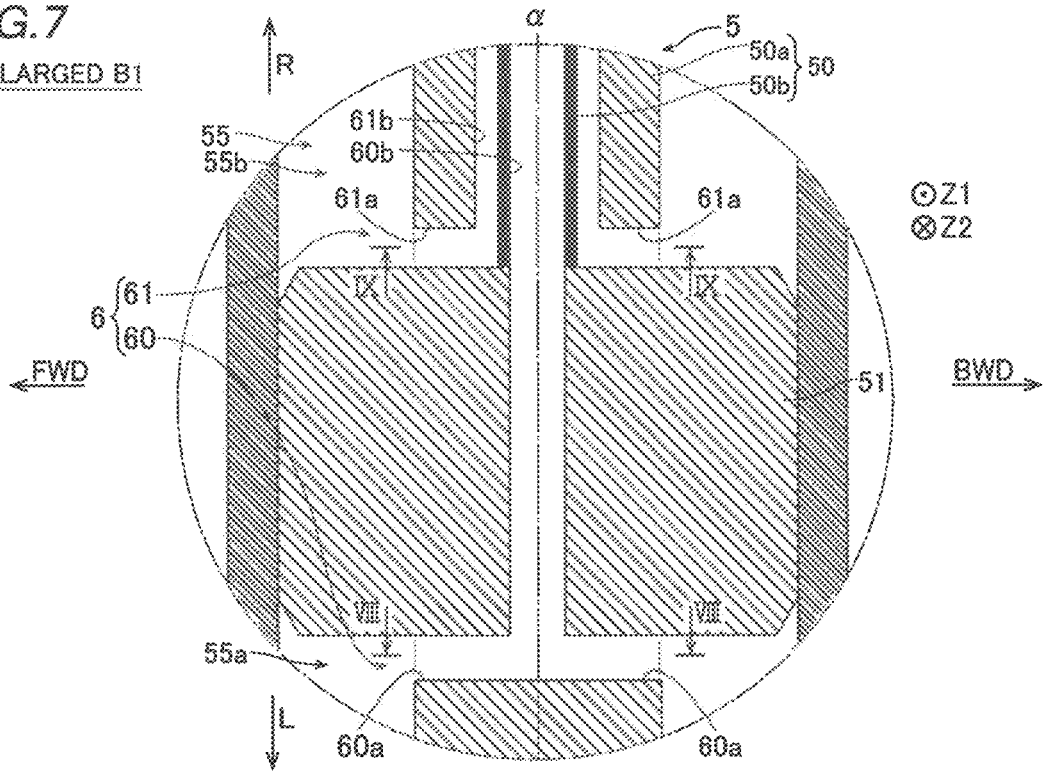
FIG. 7 is a partially enlarged view of a B1 portion in FIG. 6.
Figure 8:
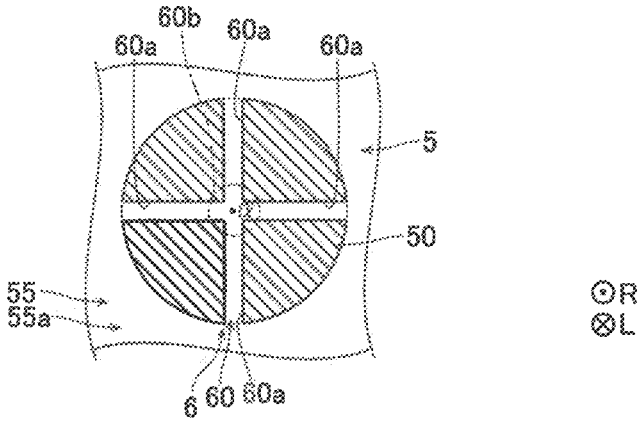
FIG. 8 is a sectional view taken along the line VIII-VIII in FIG. 7.
Figure 9:
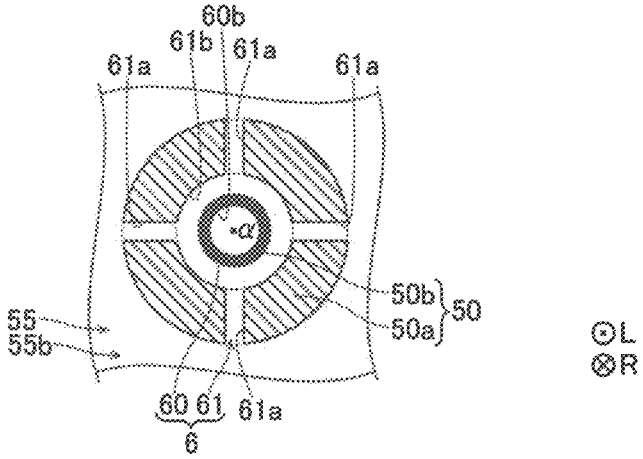
FIG. 9 is a sectional view taken along the line IX-IX in FIG. 7.

As shown in FIGS. 5 and 6, the pair of clamp brackets 2 are spaced apart from each other in the right-left direction. The clamp brackets 2 are fixed to the hull 100*a*. The swivel bracket 3 is attached to the clamp brackets 2 so as to be rotatable about tilt shafts 30 that extend in the right-left direction. The outboard motor body 1 (see FIG. 2) is attached to the swivel bracket 3 via a steering shaft 53. That is, the clamp brackets 2 rotatably support the swivel bracket 3 and the outboard motor body 1.

Each of the pair of clamp brackets 2 includes a bracket body 20 and bracket covers 21.

The bracket body 20 has a substantially L shape along the outer shape of the transom of the hull 100*a*, and is provided along the transom. Circular through-holes 20*a* that penetrate in the right-left direction are provided on an upper portion of the bracket body 20. The tilt shafts 30 are fitted into the through-holes 20*a*.

The bracket covers 21 are attached to the piston rod 50 from the outer sides of the through-holes 20*a* in the right-left direction to cover (close) the through-holes 20*a* of the bracket body 20 from the outer sides in the right-left direction. The right and left bracket covers 21 support a right end 50*c* and a left end of the piston rod 50 that extends in the right-left direction.

Specifically, the left bracket cover 21 supports the piston rod 50 and covers the left end of the piston rod 50 from the outside (left side). The right bracket cover 21 supports the piston rod 50 penetrating through the right bracket cover 21. The left bracket cover 21 is fixed to the piston rod 50 by a bolt BL, for example.

As shown in FIG. 6, the swivel bracket 3 is provided between the pair of clamp brackets 2 in the right-left direction. The pair of tilt shafts 30 are integral and unitary with the swivel bracket 3. The pair of tilt shafts 30 protrude outward in the right-left direction from the right and left sides of a main body of the swivel bracket 3 located between the pair of clamp brackets 2. The swivel bracket 3 is attached to the clamp brackets 2 via the tilt shafts 30. The swivel bracket 3 rotates in the upward-downward direction by rotating about the tilt shafts 30.

The tilt shafts 30 each include a circular through-hole 30*a* that penetrates in the right-left direction. The piston rod 50 is passed through the through-hole 30*a*. The inside of the through-hole 30*a* is also a space to provide the cylinder body 52 guided by the piston rod 50 to move in the right-left direction. That is, the internal space of the through-hole 30*a* is included in the moving range of the cylinder body 52.

As shown in FIG. 5, the power trim-tilt device 4 is fixed to the clamp brackets 2. The power trim-tilt device 4 is provided between the pair of clamp brackets 2.

The power trim-tilt device 4 includes a hydraulic cylinder 40 and a trim-tilt oil supply/discharge device 41 to supply and discharge oil to and from the hydraulic cylinder 40.

The cylinder body 52 is attached to the clamp brackets 2, and the tip end of a rod of the hydraulic cylinder 40 is attached to the swivel bracket 3, and thus the hydraulic cylinder 40 rotates the swivel bracket 3 and the outboard motor body 1 (see FIG. 2) in the upward-downward direction by moving the rod back and forth from the cylinder body 52.

The trim-tilt oil supply/discharge device 41 includes a tank to store oil, an electric motor, and an electric pump. The electric pump is driven by the electric motor, and adjusts the amount of oil in the tank to supply and discharge the oil to and from the hydraulic cylinder 40. Consequently, the rod of the hydraulic cylinder 40 moves back and forth from the cylinder body 52 to rotate the swivel bracket 3 and the outboard motor body 1 in the upward-downward direction.

As shown in FIGS. 5 and 6, the steering device 102 includes the steering cylinder 5, the oil passage 6, a bypass valve V, the metal oil pipes 7, the adapter A, and a steering oil supply/discharge device 8. The steering device 102 includes a plurality of seals (not shown) such that oil does not leak to the outside.

The steering cylinder 5 includes the piston rod 50, a piston 51, the cylinder body 52, and a rotated member 54 to support the steering shaft 53. The rotated member 54 is rotated in the right-left direction together with the steering shaft 53 and the outboard motor body 1 (see FIG. 2).

The steering cylinder 5 is rotatably attached to the clamp brackets 2 via the piston rod 50. The piston rod 50 extends in the right-left direction of the outboard motor body 1 (hull 100*a*). The piston rod 50 functions as a guide to move the cylinder body 52 in the right-left direction.

The piston rod 50 is supported by the pair of clamp brackets 2. The piston rod 50 protrudes outward in the right-left direction from one of the pair of clamp brackets 2. Specifically, the piston rod 50 penetrates through the bracket cover 21 of the right clamp bracket 2 in the right-left direction and protrudes to the right side (outward) relative to the bracket cover 21 of the right clamp bracket 2.

The oil pipes 7 are connected to a portion of the piston rod 50 that protrudes to the right side (outward) relative to the bracket cover 21 via the adapter A. The first end of the oil passage 6 is connected to the oil pipes 7, the second end of the oil passage 6 is connected to the oil chamber 55, and the oil passage 6 is provided inside the piston rod 50.

The piston rod 50 has a double pipe structure including a cylindrical large-diameter tubular portion 50*a* extending in the axial direction of the piston rod 50, and a cylindrical small-diameter tubular portion 50*b* located inward of the large-diameter tubular portion 50*a* and extending in the axial direction. The outer diameter (outer surface diameter) of the small-diameter tubular portion 50*b* is smaller than the inner diameter (inner surface diameter) of the large-diameter tubular portion 50*a*.

In the radial direction of the piston rod 50, an annular gap is provided between the small-diameter tubular portion 50*b* and the large-diameter tubular portion 50*a*. The annular gap between the small-diameter tubular portion 50*b* and the large-diameter tubular portion 50*a* and the inner side of the small-diameter tubular portion 50*b* define separate spaces separated from each other. The gap between the small-diameter tubular portion 50*b* and the large-diameter tubular portion 50*a* and the inner side (region) of the small-diameter tubular portion 50*b* define the oil passage 6 through which oil flows.

The piston rod 50 is coaxial or substantially coaxial with the tilt shafts 30. Specifically, the central axis $\alpha$ of the piston rod 50 is coaxial or substantially coaxial with the central axes of the tilt shafts 30. Therefore, when the outboard motor body 1 is rotated in the upward-downward direction by the power trim-tilt device 4, the piston rod 50 maintains the same position without moving about the central axes of the tilt shafts 30 (without moving in the upward-downward direction).

The piston 51 is fixed to the piston rod 50. The piston 51 is located at an intermediate position between the pair of clamp brackets 2 in the right-left direction. The piston 51 divides the internal space of the cylinder body 52 into two spaces: a space on the left side of the piston 51 and a space on the right side of the piston 51. The oil chamber 55 of the steering cylinder 5 includes the left oil chamber 55*a* on the left side of the piston 51 and the right oil chamber 55*b* on the right side of the piston 51.

The cylinder body 52 has a cylindrical shape and extends in the right-left direction. The piston 51 is provided inside the cylinder body 52, and the piston rod 50 is inserted in the cylinder body 52. As described above, inside the cylinder body 52, the left oil chamber 55*a* is provided on the left side of the piston 51, and the right oil chamber 55*b* is provided on the right side of the piston 51.

The steering cylinder 5 rotates the steering shaft 53 in the right-left direction to rotate the outboard motor body 1 in the right-left direction by adjusting the amount of oil in the left oil chamber 55*a* and the right oil chamber 55*b* to move the cylinder body 52 in the right-left direction.

Specifically, as shown in FIG. 6, the cylinder body 52 includes a cylindrical cylinder body main body 52*a*, a protrusion 52*b* that protrudes from the cylinder body main body 52*a* toward the outboard motor body 1 (see FIG. 2), and a link 52*c* connected to the protrusion 52*b*. The link 52*c* is also connected to the rotated member 54.

The protrusion 52*b* is integral and unitary with the cylinder body main body 52*a*. The protrusion 52*b* and the link 52*c* transmit a driving force in the right-left direction from the cylinder body main body 52*a* to the rotated member 54. The outboard motor body 1 is fixed to the rotated member 54 via a mount.

When the cylinder body 52 (cylinder body main body 52*a*) moves to the left, a driving force is transmitted from the cylinder body main body 52*a* to the rotated member 54 via the protrusion 52*b* and the link 52*c*, and the rotated member 54 rotates to the left (counterclockwise) together with the steering shaft 53 about the steering shaft 53. Consequently, the outboard motor main body 1 rotates to the left together with the rotated member 54 and the steering shaft 53.

When the cylinder body 52 moves to the right, a driving force is transmitted from the cylinder body main body 52*a* to the rotated member 54 via the protrusion 52*b* and the link 52*c*, and the rotated member 54 rotates to the right (clockwise) together with the steering shaft 53 about the steering shaft 53. Consequently, the outboard motor body 1 rotates to the right together with the rotated member 54 and the steering shaft 53.

As shown in FIGS. 6 to 12, the oil passage 6 is provided inside the piston rod 50. The oil passage 6 includes a left oil passage 60 connected to the left oil chamber 55*a* and a right oil passage 61 connected to the right oil chamber 55*b*.

The left oil passage 60 is defined by the inner side (space) of the small-diameter tubular portion 50*b*. That is, the left oil passage 60 passes through the inner side of the small-diameter tubular portion 50*b*.

Specifically, the left oil passage 60 includes a plurality of radial oil passages 60*a* connected to the left oil chamber 55*a*, an axial oil passage 60*b* connected to the radial oil passages 60*a* in the vicinity of or adjacent to a first end of the axial oil passage 60*b*, a plurality of radial oil passages 60*c* connected in the vicinity of or adjacent to a second end of the axial oil passage 60*b*, and a groove-shaped oil passage 60*d* that surrounds the radial oil passages 60*c* from the outside in the radial direction.

The plurality of radial oil passages 60*a* of the left oil passage 60 are connected to the left oil chamber 55*a* in the vicinity of or adjacent to the piston 51 in the right-left direction. The plurality of radial oil passages 60*a* branch from the axial oil passage 60*b* and extend in the radial direction of the piston rod 50 (see FIG. 8). That is, the outer peripheral ends of the radial oil passages 60*a* are connected to the left oil chamber 55*a*, and the inner peripheral ends of the radial oil passages 60*a* are connected to the axial oil passage 60*b*.

The axial oil passage 60*b* of the left oil passage 60 is located inward of the small-diameter tubular portion 50*b*. That is, the axial oil passage 60*b* has a circular shape in a cross-section perpendicular to the longitudinal direction (right-left direction) of the piston rod 50. The axial oil passage 60*b* extends linearly in the axial direction (right-left direction) of the piston rod 50. In the right-left direction, the axial oil passage 60*b* extends from the vicinity of the right end 50*c* of the piston rod 50 to a portion of the left oil chamber 55*a* in the vicinity of or adjacent to the piston 51.

The plurality of radial oil passages 60*c* of the left oil passage 60 are located in the vicinity of or adjacent to the right end 50*c* of the piston rod 50. The plurality of radial oil passages 60*c* branch from the axial oil passage 60*b* and extend in the radial direction of the piston rod 50 (see FIG. 11). That is, the inner peripheral ends of the radial oil passages 60*c* are connected to the axial oil passage 60*b*, and the outer peripheral ends of the radial oil passages 60*c* are connected to the groove-shaped oil passage 60*d*.

Figure 10:
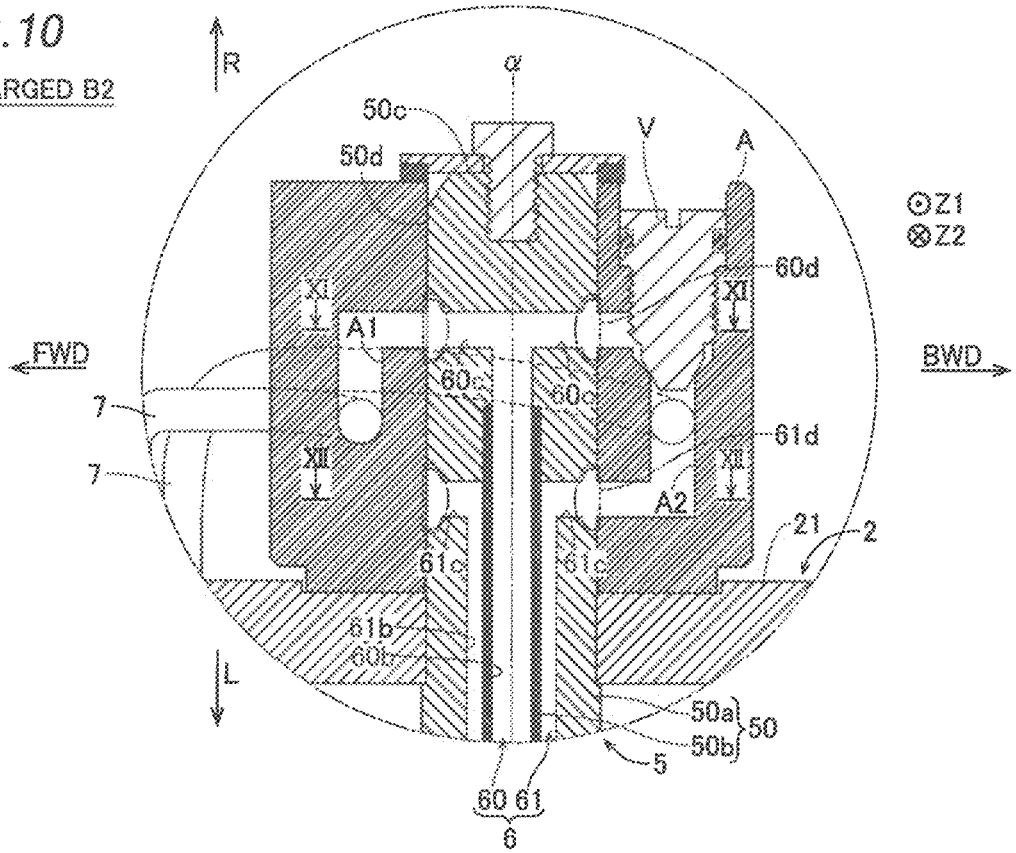
FIG. 10 is a partially enlarged view of a B2 portion in FIG. 6.
Figure 11:
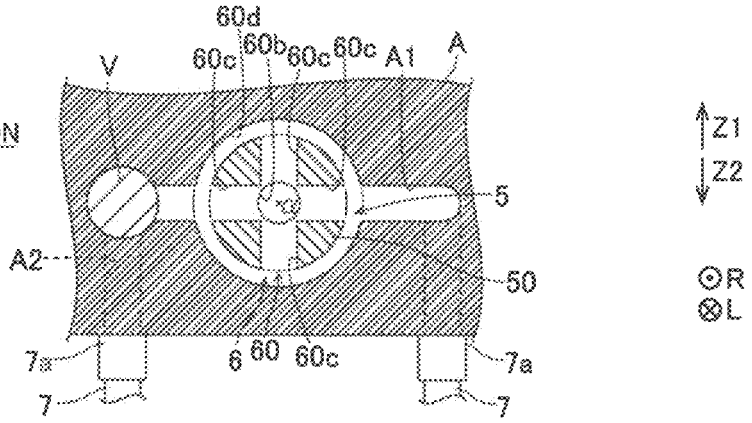
FIG. 11 is a sectional view taken along the line XI-XI in FIG. 10.

The groove-shaped oil passage 60*d* of the left oil passage 60 has an annular shape that extends in the circumferential direction of the piston rod 50 along the outer peripheral surface 50*d* (see FIG. 10) of the right end 50*c* of the piston rod 50 that is covered by the adapter A (see FIG. 11). The groove-shaped oil passage 60*d* is in constant communication with connection ports 7*a* of the oil pipes 7 to the adapter A regardless of the rotation position of the piston rod 50.

The right oil passage 61 is defined by the gap between the small-diameter tubular portion 50*b* and the large-diameter tubular portion 50*a*. That is, the right oil passage 61 passes through the outside of the small-diameter tubular portion 50*b*.

Specifically, the right oil passage 61 includes a plurality of radial oil passages 61*a* connected to the right oil chamber 55*b*, an axial oil passage 61*b* connected to the radial oil passages 61*a* in the vicinity of or adjacent to a first end of the axial oil passage 61*b*, a plurality of radial oil passages 61*c* connected in the vicinity of or adjacent to a second end of the axial oil passage 61*b*, and a groove-shaped oil passage 61*d* that surrounds the radial oil passages 61*c* from the outside in the radial direction.

The plurality of radial oil passages 61*a* of the right oil passage 61 are connected to the right oil chamber 55*b* in the vicinity of the piston 51 in the right-left direction. The plurality of radial oil passages 61*a* branch from the axial oil passage 61*b* and extend in the radial direction of the piston rod (see FIG. 9). That is, the outer peripheral ends of the radial oil passages 61*a* are connected to the right oil passage 61, and the inner peripheral ends of the radial oil passages 61*a* are connected to the axial oil passage 61*b*.

The axial oil passage 61*b* of the right oil passage 61 is defined by the gap between the small-diameter tubular portion 50*b* and the large-diameter tubular portion 50*a*. That is, the axial oil passage 61*b* has an annular shape in a cross-section perpendicular to the longitudinal direction (right-left direction) of the piston rod 50. The axial oil passage 61*b* extends linearly in the axial direction (right-left direction) of the piston rod 50. In the right-left direction, the axial oil passage 61*b* extends from the vicinity of the right end 50*c* of the piston rod 50 to a portion of the right oil chamber 55*b* in the vicinity of or adjacent to the piston 51. That is, oil is supplied from the vicinity of the same (right) outer end 50*c* of the piston rod 50 to the left oil passage 60 and the right oil passage 61, and oil is discharged from the left oil passage 60 and the right oil passage 61 to the vicinity of the same (right) outer end 50*c* of the piston rod 50.

As an example, in the cross-section perpendicular to the longitudinal direction (right-left direction) of the piston rod 50, the annular axial oil passage 61*b* of the right oil passage 61 has substantially the same flow passage sectional area as the circular axial oil passage 60*b* of the left oil passage 60.

The plurality of radial oil passages 61*c* of the right oil passage 61 are provided in the vicinity of or adjacent to the right end 50*c* of the piston rod 50. The plurality of radial oil passages 61*c* branch from the axial oil passage 61*b* and extend in the radial direction of the piston rod 50 (see FIG. 12). That is, the inner peripheral ends of the radial oil passages 61*c* are connected to the axial oil passage 61*b*, and the outer peripheral ends of the radial oil passages 61*c* are connected to the groove-shaped oil passage 61*d*.

Figure 12:
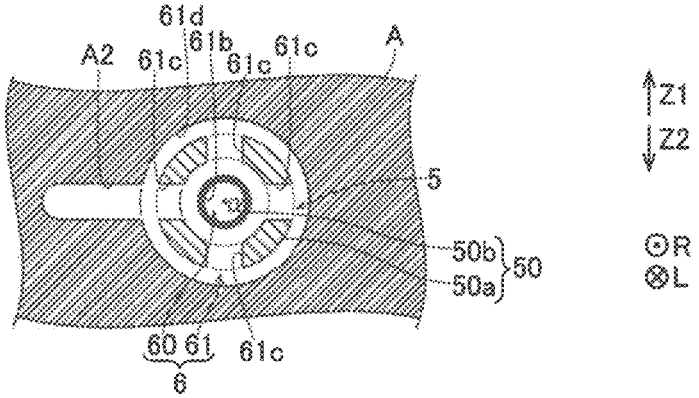
FIG. 12 is a sectional view taken along the line XII-XII in FIG. 10.

The groove-shaped oil passage 61*d* of the right oil passage 61 has an annular shape and extends in the circumferential direction of the piston rod 50 along the outer peripheral surface 50*d* (see FIG. 10) of the right end 50*c* of the piston rod 50 that is covered by the adapter A (see FIG. 12). Therefore, the groove-shaped oil passage 61*d* is in constant communication with the connection ports 7*a* of the oil pipes 7 to the adapter A regardless of the rotation position of the piston rod 50.

As shown in FIGS. 6 and 10, the bypass valve V is openable and closable in the vicinity of or adjacent to the right end 50*c* of the piston rod 50. The bypass valve V is provided in the adapter A. The bypass valve V communicates a connection path A1 with a connection path A2 when the bypass valve V is opened. Consequently, the bypass valve V communicates the left oil passage 60 with the right oil passage 61.

When the bypass valve V is opened, the cylinder body 52 of the steering cylinder 5 is able to be manually moved in the right-left direction, and the outboard motor body 1 (see FIG. 2) is able to be manually rotated in the right-left direction. In principle, the bypass valve V is maintained in a closed state, but is opened during maintenance of the outboard motor 101, for example.

The adapter A is provided at the right end 50*c* of the piston rod 50, and connects the oil passage 6 to the oil pipes 7. Specifically, the connection path A1 that connects one of the oil pipes 7 to the left oil chamber 55*a* and the connection path A2 that connects the other of the oil pipes 7 to the right oil chamber 55*b* are provided inside the adapter A (see FIG. 10). The connection path A1 and the connection path A2 are independent oil passages that do not communicate with each other when the bypass valve V is closed.

The connection path A1 directly communicates with (is directly connected to) the groove-shaped oil passage 60*d* of the left oil passage 60. The connection path A2 directly communicates with (is directly connected to) the groove-shaped oil passage 61*d* of the right oil passage 61.

The adapter A engages with the right end 50*c* of the piston rod 50 and is rotatable with respect to the piston rod 50. When the outboard motor body 1 (see FIG. 2) and the swivel bracket 3 rotate in the upward-downward direction, the adapter A is maintained at a predetermined rotation position about the central axis $\alpha$ of the piston rod 50 without rotating about the central axis $\alpha$ of the piston rod 50. In short, the adapter A does not change its orientation even when the outboard motor body 1 rotates in the upward-downward direction.

The oil pipes 7 include two pipes: a pipe connected to the left oil chamber 55*a* via the left oil passage 60 and a pipe connected to the right oil chamber 55*b* via the right oil passage 61. The oil pipes 7 supply oil to the oil chamber 55 and discharge the oil from the oil chamber 55. The oil pipes 7 connect the oil passage 6 to the steering oil supply/discharge device 8 (see FIG. 5) via the front sides of the clamp bracket 2 and the swivel bracket 3. The oil pipes 7 are connected to the adapter A from below and from the front side.

The oil pipes 7 are connected to the oil passage 6 provided in the piston rod 50 via the adapter A in the vicinity of or adjacent to the right end 50*c* of the piston rod 50. That is, the oil pipes 7 are connected to the oil passage 6 via the adapter A on one of the outer sides of the pair of clamp brackets 2 in the right-left direction. Furthermore, the oil pipes 7 are connected to the oil passage 6 via the adapter A on the outer side of the moving range of the cylinder body 52 in the right-left direction.

The oil pipes 7 are made of metal, and the shapes of the oil pipes 7 do not change substantially. The oil pipes 7 are connected to the adapter A to maintain the positions of the connection ports 7*a* of the oil pipes 7.

The steering oil supply/discharge device 8 shown in FIG. 5 supplies and discharges oil to and from the oil chamber 55 via the oil passage 6 and the oil pipes 7.

Specifically, the steering oil supply/discharge device 8 discharges the oil from the right oil chamber 55*b* via the right oil passage 61 at the same time as supplying oil to the left oil chamber 55*a* via the left oil passage 60. Consequently, the cylinder body 52 moves to the left, and the steering shaft 53 and the outboard motor body 1 (see FIG. 2) rotate to the left (counterclockwise).

On the other hand, the steering oil supply/discharge device 8 supplies oil to the right oil chamber 55*b* via the right oil passage 61 at the same time as discharging the oil from the left oil chamber 55*a* via the left oil passage 60. Consequently, the cylinder body 52 moves to the right, and the steering shaft 53 and the outboard motor body 1 rotate to the right (clockwise).

The steering oil supply/discharge device 8 is attached to one of the pair of clamp brackets 2 to which the piston rod 50 is attached. Specifically, the steering oil supply/discharge device 8 is fixed to the clamp bracket 2 via fasteners F. In the right-left direction, the steering oil supply/discharge device 8 is provided on the same side (right side) as the side on which the adapter A is provided.

The steering oil supply/discharge device 8 includes a tank 80, the electric pump 81, and an electric motor 82.

The electric pump 81 is driven by the electric motor 82, and adjusts the amount of oil in the tank 80 to supply the oil to the steering cylinder 5 and discharge the oil from the steering cylinder 5. Consequently, the cylinder body 52 of the steering cylinder 5 moves in the right-left direction along the piston rod 50, and the steering shaft 53 and the outboard motor body 1 rotate in the right-left direction.

According to the first preferred embodiment of the present invention, the following advantageous effects are achieved.

According to the first preferred embodiment of the present invention, the outboard motor 101 includes the steering cylinder 5 to rotate the steering shaft 53 and rotate the outboard motor body 1 in the right-left direction by adjusting the amount of oil in the oil chamber 55 and moving the cylinder body 52 in the right-left direction, and the oil passage 6 provided inside the piston rod 50 and connected to the oil chamber 55. Accordingly, the oil passage 6 is provided inside the piston rod 50 that does not move in the right-left direction, instead of the cylinder body 52 that moves in the right-left direction when the outboard motor body 1 is rotated in the right-left direction, and thus the oil passage 6 is prevented from moving in the right-left direction when the outboard motor body 1 is rotated in the right-left direction. Therefore, the oil pipes 7 connected to the piston rod 50 (oil passage 6) are prevented from moving in the right-left direction. Consequently, it is no longer necessary to provide, in the right-left direction of the outboard motor body 1, a moving space for the oil pipes 7 to move in the right-left direction, unlike the conventional case, and thus a larger space is provided in the vicinity of or adjacent to a stern to which the outboard motor 101 is attached.

According to the first preferred embodiment of the present invention, the outboard motor 101 further includes the oil pipes 7 connected to the oil passage 6 provided in the piston rod 50 in the vicinity of or adjacent to the end of the piston rod 50. When the oil passage 6 is provided inside the piston rod 50, it is necessary to limit the moving range of the cylinder body 52 in the right-left direction to a range that does not interfere with the oil pipes 7 such that the cylinder body 52 does not interfere with the oil pipes 7. Therefore, with the structure described above, the oil pipes 7 are connected to the oil passage 6 in the vicinity of or adjacent to the end of the piston rod 50, and thus a larger moving range of the cylinder body 52 in the right-left direction is provided. Thus, a larger space is provided in the vicinity of or adjacent to the stern to which the outboard motor 101 is attached, and a larger moving range of the cylinder body 52 in the right-left direction is provided.

According to the first preferred embodiment of the present invention, the outboard motor 101 further includes the swivel bracket 3 that allows the outboard motor body 1 to be attached thereto and that is rotatable in the upward-downward direction, and the clamp brackets 2 fixed to the hull 100*a*, and the steering cylinder 5 is rotatably attached to the clamp brackets 2. Accordingly, the steering cylinder 5 is rotatably attached to the clamp brackets 2 that do not rotate in the upward-downward direction, and thus the steering cylinder 5 is prevented from moving in the upward-downward direction when the outboard motor body 1 is rotated together with the swivel bracket 3 in the upward-downward direction. Consequently, it is not necessary to provide, in the upward-downward direction, a moving space for the oil pipes 7 to move in the upward-downward direction, and thus a larger space is provided in the vicinity of or adjacent to the stern to which the outboard motor 101 is attached.

According to the first preferred embodiment of the present invention, the outboard motor 101 further includes the power trim-tilt device 4 to rotate the swivel bracket 3 and the outboard motor body 1 in the upward-downward direction about the tilt shaft 30, and the piston rod 50 with the oil passage 6 being provided therein is coaxial or substantially coaxial with the tilt shaft 30. Accordingly, the piston rod 50 is coaxial or substantially coaxial with the tilt shaft 30, and thus when the outboard motor body 1 is rotated in the upward-downward direction about the tilt shaft 30, distances between the piston rod 50 and both the outboard motor body 1 that rotates in the upward-downward direction and the steering shaft 53 that is the center of rotation of the outboard motor body 1 in the right-left direction are maintained substantially constant. Consequently, the power trim-tilt device 4 smoothly rotates the outboard motor body 1 in the upward-downward direction, and the steering cylinder 5 smoothly rotates the outboard motor body 1 in the right-left direction.

According to the first preferred embodiment of the present invention, the outboard motor 101 further includes the steering oil supply/discharge device 8 to supply and discharge oil to and from the oil chamber 55 via the oil passage 6, and the steering oil supply/discharge device 8 is attached to the clamp bracket 2 to which the piston rod 50 is attached. Accordingly, the steering oil supply/discharge device 8 connected to the steering cylinder 5 via the oil pipes 7 is also attached to the same clamp bracket 2 as the steering cylinder 5, and thus movement of the oil pipes 7 in the vicinity of or adjacent to both ends of the oil pipes 7 is effectively significantly reduced or prevented. Consequently, a larger space is provided in the vicinity of or adjacent to the stern to which the outboard motor 101 is attached.

According to the first preferred embodiment of the present invention, the outboard motor 101 further includes the oil pipes 7 connected to the oil passage 6 provided in the piston rod 50 in the vicinity of or adjacent to the end of the piston rod 50, and the adapter A provided at the end 50*c* of the piston rod 50 to connect the oil passage 6 to the oil pipes 7, and the adapter A is maintained at the predetermined rotation position about the central axis $\alpha$ of the piston rod 50 without rotating about the central axis $\alpha$ of the piston rod 50 when the outboard motor body 1 and the swivel bracket 3 rotate in the upward-downward direction. Accordingly, when the outboard motor body 1 and the swivel bracket 3 rotate in the upward-downward direction, the adapter A is maintained at the predetermined rotation position about the central axis $\alpha$ of the piston rod 50 also at ends of the oil pipes 7 connected to the adapter A. Therefore, in addition to restriction of movement of the oil pipes 7 in the right-left direction and in the upward-downward direction, the adapter A is maintained at the predetermined rotation position about the central axis $\alpha$ of the piston rod 50, and thus movement of the oil pipes 7 is more effectively significantly reduced or prevented. Consequently, a particularly large space is provided in the vicinity of or adjacent to the stern to which the outboard motor 101 is attached.

According to the first preferred embodiment of the present invention, the adapter A engages with the end 50*c* of the piston rod 50 and is rotatable with respect to the piston rod 50, the oil passage 6 includes the groove-shaped oil passages 60*d* and 61*d* that extend in the circumferential direction of the piston rod 50 along the outer peripheral surface 50*d* of the piston rod 50 that is covered by the adapter A, and the groove-shaped oil passages 60*d* and 61*d* are in constant communication with the connection ports 7*a* of the oil pipes 7 to the adapter A regardless of the rotation position of the piston rod 50. Accordingly, even when the piston rod 50 with the oil passage 6 provided therein rotates, with the groove-shaped oil passages 60*d* and 61*d* that extend in the circumferential direction of the piston rod 50 along the outer peripheral surface 50*d* of the piston rod 50 that is covered by the adapter A, the oil pipes 7 are reliably connected to the oil passage 6 (groove-shaped oil passages 60*d* and 61*d*).

According to the first preferred embodiment of the present invention, the oil pipes 7 are made of metal, and are connected to the adapter A to maintain the positions of the connection ports 7*a* of the oil pipes 7. Accordingly, the oil pipes 7 are made of metal and maintain the positions of the connection ports 7*a* of the oil pipes 7 to the adapter A, and thus a change in the shapes of the oil pipes 7 is significantly reduced or prevented. Consequently, the oil pipes 7 are fixed in a predetermined space, and thus a larger space is provided in the vicinity of or adjacent to the stern to which the outboard motor 101 is attached.

According to the first preferred embodiment of the present invention, the piston rod 50 protrudes outward from the clamp bracket 2 in the right-left direction, and the oil pipes 7 are connected to the oil passage 6 via the adapter A on the outer side of the clamp bracket 2 in the right-left direction. Accordingly, the oil pipes 7 are provided on the outer side of the clamp bracket 2 in the left-right direction, and thus the oil pipes 7 are provided at positions at which the cylinder body 52 is unlikely to interfere with the oil pipes 7.

According to the first preferred embodiment of the present invention, the oil passage 6 is connected to the oil chamber 55 in the vicinity of or adjacent to the piston 51. Accordingly, when the cylinder body 52 is moved in the right-left direction, the cylinder body 52 is moved to the vicinity of the piston 51 within a range in which the oil passage 6 is not blocked by the cylinder body 52. That is, a larger moving range of the cylinder body 52 is provided in the right-left direction.

According to the first preferred embodiment of the present invention, the oil chamber 55 includes the left oil chamber 55*a* on the left side of the piston 51 and the right oil chamber 55*b* on the right side of the piston 51, the oil passage 6 includes the left oil passage 60 connected to the left oil chamber 55*a*, and the right oil passage 61 connected to the right oil chamber 55*b*, oil is supplied from the vicinity of the same outer end of the piston rod 50 to the left oil passage 60 and the right oil passage 61, and oil is discharged from the left oil passage 60 and the right oil passage 61 to the vicinity of the same outer end of the piston rod 50. Accordingly, the oil pipes 7 are provided on the same outer side of the piston rod 50, and thus unlike a case in which the left oil passage 60 and the right oil passage 61 are provided in the vicinity of different outer ends of the piston rod 50, respectively, the device structure is simplified.

According to the first preferred embodiment of the present invention, the piston rod 50 has a double pipe structure including the large-diameter tubular portion 50*a* extending in the axial direction of the piston rod 50 and the small-diameter tubular portion 50*b* located inward of the large-diameter tubular portion 50*a* and extending in the axial direction, the left oil passage 60 is defined by one of the inner side of the small-diameter tubular portion 50*b* and the gap between the large-diameter tubular portion 50*a* and the small-diameter tubular portion 50*b*, and the right oil passage 61 is defined by the other of the inner side of the small-diameter tubular portion 50*b* and the gap between the large-diameter tubular portion 50*a* and the small-diameter tubular portion 50*b*. Accordingly, the piston rod 50 has a double pipe structure including the large-diameter tubular portion 50*a* and the small-diameter tubular portion 50*b* such that two different oil passages (the left oil passage 60 and the right oil passage 61) that do not communicate with each other in a cross-section perpendicular to the longitudinal direction of the piston rod 50 are easily provided with respect to the piston rod 50.

According to the first preferred embodiment of the present invention, the outboard motor 101 further includes the bypass valve V provided in the vicinity of or adjacent to the end of the piston rod 50 to communicate the left oil passage 60 with the right oil passage 61 when the bypass valve V is opened. Accordingly, the bypass valve V communicates the left oil passage 60 with the right oil passage 61 to allow the cylinder body 52 to be manually moved. Consequently, the cylinder body 52 is manually moved to easily perform maintenance work such as removing air from the inside of the cylinder body 52.

According to the first preferred embodiment of the present invention, the oil passage 6 includes the axial oil passages 60*b* and 61*b* that extend in the axial direction of the piston rod 50, and the plurality of radial oil passages 60*a* and 61*a* that branch from the axial oil passages 60*b* and 61*b*, extend in the radial direction of the piston rod 50, and are connected to the oil chamber 55. Accordingly, due to the plurality of radial oil passages 60*a* and 61*a*, a flow passage sectional area between the oil chamber 55 and the axial oil passages 60*b* and 61*b* is increased. Consequently, when oil is supplied from the axial oil passages 60*b* and 61*b* to the oil chamber 55 and when oil is discharged from the oil chamber 55 to the axial oil passages 60*b* and 61*b*, the plurality of radial oil passages 60*a* and 61*a* allow the oil to flow smoothly between the oil chamber 55 and the axial oil passages 60*b* and 61*b*.

According to the first preferred embodiment of the present invention, the outboard motor 101 further includes the electric pump 81 that is driven based on the electric signal E transmitted from the steering wheel 100*b* with the operation of the steering wheel 100*b* to adjust the amount of oil in the oil chamber 55. Accordingly, in the marine vessel 100 of a type in which the amount of oil in the oil chamber 55 is adjusted using the electric pump 81, which is a structure of the outboard motor 101, a larger space is provided in the vicinity of or adjacent to the stern to which the outboard motor 101 is attached.

Second Preferred Embodiment

Figure 13:
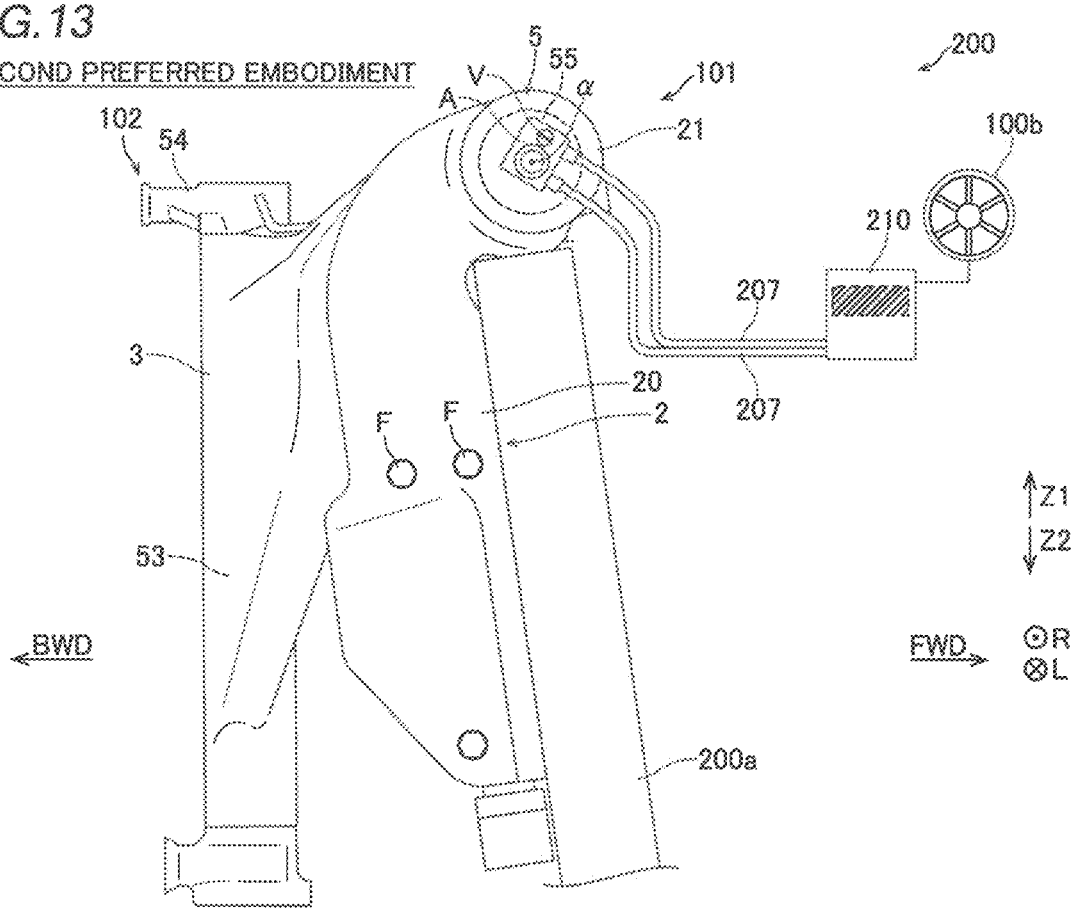
FIG. 13 is a diagram showing the outboard motor and a steering wheel driven pump according to the second preferred embodiment of the present invention.

A second preferred embodiment of the present invention is now described with reference to FIGS. 6 and 13. In the second preferred embodiment, oil is directly supplied to a steering cylinder 5 from a steering wheel driven pump 210, which is a structure on a hull 200*a*, unlike the first preferred embodiment in which oil is directly supplied to the steering cylinder 5 from the electric pump 81, which is a structure of the outboard motor 101. In the figures, the same or similar structures as those of the first preferred embodiment are denoted by the same reference numerals.

A marine vessel 200 according to the second preferred embodiment of the present invention includes the steering wheel driven pump 210.

The steering wheel driven pump 210 is mounted on the hull 200*a*. The steering wheel driven pump 210 is directly driven by a steering wheel 100*b*. Specifically, the steering wheel driven pump 210 is mechanically driven with the operation of the steering wheel 100*b* to adjust the amount of oil in an oil chamber 55 of the steering cylinder 5.

The steering wheel driven pump 210 is connected to an oil passage 6 provided inside a piston rod 50 of the steering cylinder 5 via oil pipes 207 (see FIG. 6).

The remaining structures of the second preferred embodiment are similar to those of the first preferred embodiment.

According to the second preferred embodiment of the present invention, the following advantageous effects are achieved.

According to the second preferred embodiment of the present invention, the marine vessel 200 includes the steering cylinder 5 to rotate a steering shaft 53 and rotate an outboard motor body 1 in a right-left direction by adjusting the amount of oil in the oil chamber 55 and moving a cylinder body 52 in the right-left direction, and the oil passage 6 provided inside the piston rod 50 and connected to the oil chamber 55. Accordingly, a larger space is provided in the vicinity of or adjacent to a stern to which an outboard motor 101 is attached, similarly to the first preferred embodiment.

According to the second preferred embodiment of the present invention, the hull 200*a* includes the steering wheel driven pump 210 mechanically driven with the operation of the steering wheel 100*b* to adjust the amount of oil in the oil chamber 55. Accordingly, in the marine vessel 200 of a type in which the amount of oil in the oil chamber 55 is adjusted using the steering wheel driven pump 210, which is a structure on the hull 200*a*, a larger space is provided in the vicinity of or adjacent to the stern to which the outboard motor 101 is attached.

The remaining advantageous effects of the second preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the marine vessel preferably includes one outboard motor in each of the first and second preferred embodiments described above, the present invention is not restricted to this. In the present invention, the marine vessel may alternatively include a plurality of outboard motors.

While the swivel bracket and the tilt shaft are preferably integral and unitary with each other in each of the first and second preferred embodiments described above, the present invention is not restricted to this. In the present invention, the swivel bracket and the tilt shaft may alternatively be separate from each other. In such a case, the clamp brackets and the tilt shaft may be integral and unitary with each other.

While the adapter is preferably provided at the right end of the piston rod in each of the first and second preferred embodiments described above, the present invention is not restricted to this. In the present invention, the adapter may alternatively be provided at a left end of the piston rod. That is, the oil pipes may be connected to the left end of the piston rod.

While the steering cylinder preferably includes two oil chambers (the left oil chamber and the right oil chamber) in each of the first and second preferred embodiments described above, the present invention is not restricted to this. In the present invention, the steering cylinder may alternatively include only one oil chamber.

While the oil pipes are preferably made of metal in each of the first and second preferred embodiments described above, the present invention is not restricted to this. In the present invention, the oil pipes may alternatively be made of a material other than metal, such as resin.

While the oil pipes and the oil passage of the piston rod are preferably connected to each other on one of the outer sides of the pair of clamp brackets in each of the first and second preferred embodiments described above, the present invention is not restricted to this. In the present invention, the oil pipes and the oil passage of the piston rod may alternatively be connected to each other between (on the inner side of) the pair of clamp brackets.

While the piston rod is preferably coaxial or substantially coaxial with the tilt shaft in each of the first and second preferred embodiments described above, the present invention is not restricted to this. In the present invention, the piston rod may alternatively be shifted from the tilt shaft. That is, the central axis of the piston rod and the central axis of the tilt shaft may be located at different positions from each other.

While the two oil passages are preferably defined by the piston rod with a double pipe structure in each of the first and second preferred embodiments described above, the present invention is not restricted to this. In the present invention, the two oil passages may alternatively have the same or similar circular shapes, for example.

While the oil passage is preferably provided inside the piston rod to include the radial oil passages, the axial oil passages, and the groove-shaped oil passages in each of the first and second preferred embodiments described above, the present invention is not restricted to this. In the present invention, the oil passage may alternatively have any shape inside the piston rod as long as the oil chamber and the oil pipes are connected to each other by the oil passage.

While the oil passage is preferably connected to the oil chamber in the vicinity of or adjacent to the piston in each of the first and second preferred embodiments described above, the present invention is not restricted to this. In the present invention, the oil passage may alternatively be connected to the oil chamber at a position farther away from the vicinity of the piston.

While the steering oil supply/discharge device is preferably attached to the clamp bracket in the first preferred embodiment described above, the present invention is not restricted to this. In the present invention, the steering oil supply/discharge device may alternatively be attached to a component different from the clamp bracket, such as a swivel bracket.

While preferred embodiments of the present invention have been described above, variations and modifications will be apparent to those skilled in the art without departing from the scope and spirit of the present invention. The scope of the present invention, therefore, is to be determined solely by the following claims.

What is claimed is:

1. An outboard motor comprising:
- an outboard motor body;
- a steering shaft;
- a steering cylinder including:
  - a piston rod extending in a right-left direction of the outboard motor body;
  - a piston fixed to the piston rod; and
  - a cylinder body including an oil chamber and the piston therein;
- an oil passage inside the piston rod and connected to the oil chamber;
- a swivel bracket attached to the outboard motor body and rotatable in an upward-downward direction; and
- a clamp bracket fixable to a hull and attached to the swivel bracket such that the swivel bracket is rotatable in the upward-downward direction; wherein
- the steering cylinder is operable to rotate the steering shaft and the outboard motor body in the right-left direction by adjusting an amount of oil in the oil chamber and moving the cylinder body in the right-left direction; and
- the steering cylinder is rotatably attached to the clamp bracket.

2. The outboard motor according to claim 1, further comprising:
- an oil pipe connected to the oil passage in the piston rod in a vicinity of or adjacent to an end of the piston rod.

3. The outboard motor according to claim 1, further comprising:
- a rotation device to rotate the swivel bracket and the outboard motor body in the upward-downward direction about a tilt shaft; wherein
- the piston rod is coaxial or substantially coaxial with the tilt shaft.

4. The outboard motor according to claim 1, further comprising:
- a steering oil supply/discharge device to supply and discharge oil to and from the oil chamber via the oil passage; wherein
- the steering oil supply/discharge device is attached to the clamp bracket.

5. The outboard motor according to claim 4, further comprising:

an oil pipe connected to the oil passage in the piston rod in a vicinity of or adjacent to an end of the piston rod; and an adapter at the end of the piston rod to connect the oil passage to the oil pipe; wherein the adapter is maintained at a predetermined rotation position about a central axis of the piston rod without rotating about the central axis when the outboard motor body and the swivel bracket rotate in the upward-downward direction.

6. The outboard motor according to claim 5, wherein the adapter is engaged with the end of the piston rod and rotatable with respect to the piston rod;

the oil passage includes a groove-shaped oil passage extending in a circumferential direction of the piston rod along an outer peripheral surface of the piston rod that is covered by the adapter; and the groove-shaped oil passage communicates with a connection port of the oil pipe to the adapter regardless of a rotation position of the piston rod.

7. The outboard motor according to claim 6, wherein the oil pipe is made of metal, and is connected to the adapter to maintain a position of the connection port of the oil pipe.

8. The outboard motor according to claim 5, wherein the piston rod protrudes outward from the clamp bracket in the right-left direction; and the oil pipe is connected to the oil passage via the adapter on an outer side of the clamp bracket in the right-left direction.

9. The outboard motor according to claim 1, wherein the oil passage is connected to the oil chamber in a vicinity of or adjacent to the piston.

10. The outboard motor according to claim 1, wherein the oil chamber includes a left oil chamber on a left side of the piston and a right oil chamber on a right side of the piston;

the oil passage includes a left oil passage connected to the left oil chamber, and a right oil passage connected to the right oil chamber; and oil is supplied from a vicinity of a same outer end of the piston rod to the left oil passage and the right oil passage, and oil is discharged from the left oil passage and the right oil passage to the vicinity of the same outer end of the piston rod.

11. An outboard motor comprising:

an outboard motor body;

a steering shaft;

a steering cylinder including:

a piston rod extending in a right-left direction of the outboard motor body;

a piston fixed to the piston rod; and a cylinder body including an oil chamber and the piston therein; and an oil passage inside the piston rod and connected to the oil chamber; wherein the steering cylinder is operable to rotate the steering shaft and the outboard motor body in the right-left direction by adjusting an amount of oil in the oil chamber and moving the cylinder body in the right-left direction;

the oil chamber includes a left oil chamber on a left side of the piston and a right oil chamber on a right side of the piston;

the oil passage includes a left oil passage connected to the left oil chamber, and a right oil passage connected to the right oil chamber; and oil is supplied from a vicinity of a same outer end of the piston rod to the left oil passage and the right oil passage, and oil is discharged from the left oil passage and the right oil passage to the vicinity of the same outer end of the piston rod.

12. The outboard motor according to claim 11, further comprising:

a bypass valve in a vicinity of or adjacent to an end of the piston rod to communicate the left oil passage with the right oil passage when the bypass valve is opened.

13. The outboard motor according to claim 1, wherein the oil passage includes an axial oil passage extending in an axial direction of the piston rod, and a plurality of radial oil passages that branch from the axial oil passage, extend in a radial direction of the piston rod, and are connected to the oil chamber.

14. A marine vessel comprising:

a hull including a steering wheel; and an outboard motor attached to the hull; wherein the outboard motor includes:

an outboard motor body;

a steering shaft;

a steering cylinder including:

a piston rod extending in a right-left direction of the outboard motor body;

a piston fixed to the piston rod; and a cylinder body including an oil chamber and the piston therein;

an oil passage inside the piston rod and connected to the oil chamber;

a swivel bracket attached to the outboard motor body and rotatable in an upward-downward direction; and a clamp bracket fixed to the hull and attached to the swivel bracket such that the swivel bracket is rotatable in the upward-downward direction; wherein the steering cylinder is operable to rotate the steering shaft and the outboard motor body in the right-left direction by adjusting an amount of oil in the oil chamber and moving the cylinder body in the right-left direction based on an operation of the steering wheel; and the steering cylinder is rotatably attached to the clamp bracket.

15. The marine vessel according to claim 14, wherein the outboard motor further includes an electric pump that is driven based on an electric signal transmitted from the steering wheel to adjust the amount of oil in the oil chamber.

16. The marine vessel according to claim 14, wherein the hull further includes a steering wheel driven pump that is mechanically driven based on an operation of the steering wheel to adjust the amount of oil in the oil chamber.

17. The marine vessel according to claim 14, wherein the outboard motor further includes an oil pipe connected to the oil passage in the piston rod in a vicinity of or adjacent to an end of the piston rod.

18. The marine vessel according to claim 14, wherein the outboard motor further includes a rotation device to rotate the swivel bracket and the outboard motor body in the upward-downward direction about a tilt shaft; and the piston rod is coaxial or substantially coaxial with the tilt shaft.

19. The outboard motor according to claim 11, wherein the piston rod includes a double pipe structure including a large-diameter tubular portion extending in an axial direction of the piston rod and a small-diameter tubular portion located inward of the large-diameter tubular portion and extending in the axial direction;

the left oil passage is defined by one of an inner side of the small-diameter tubular portion and a gap between the large-diameter tubular portion and the small-diameter tubular portion; and the right oil passage is defined by another of the inner side of the small-diameter tubular portion and the gap between the large-diameter tubular portion and the small-diameter tubular portion.

20. A marine vessel comprising:

a hull including a steering wheel; and an outboard motor attached to the hull; wherein the outboard motor includes:

an outboard motor body;

a steering shaft;

a steering cylinder including:

a piston rod extending in a right-left direction of the outboard motor body;

a piston fixed to the piston rod; and a cylinder body including an oil chamber and the piston therein; and an oil passage inside the piston rod and connected to the oil chamber; wherein the steering cylinder is operable to rotate the steering shaft and the outboard motor body in the right-left direction by adjusting an amount of oil in the oil chamber and moving the cylinder body in the right-left direction based on an operation of the steering wheel;

the oil chamber includes a left oil chamber on a left side of the piston and a right oil chamber on a right side of the piston;

the oil passage includes a left oil passage connected to the left oil chamber, and a right oil passage connected to the right oil chamber; and oil is supplied from a vicinity of a same outer end of the piston rod to the left oil passage and the right oil passage, and oil is discharged from the left oil passage and the right oil passage to the vicinity of the same outer end of the piston rod.

* * * * *